US006065478A

United States Patent [19]

Hartelius et al.

[11] Patent Number: 6,065,478

[45] Date of Patent: May 23, 2000

[54] FINGERNAIL STAMPER CRAFT SET

[75] Inventors: Mark E. Hartelius, Tinley Park; Richard W. Carton; Jeff A. Alward, both of Chicago, all of Ill.

[73] Assignee: Strombecker Corporation, Chicago, Ill.

[21] Appl. No.: 09/244,287

[22] Filed: Feb. 3, 1999

[51] Int. Cl.[7] ..... A45D 29/00

[52] U.S. Cl. ..... 132/73; 211/39; 211/128.1

[58] Field of Search ..... 132/73, 73.5, 73.6, 132/75, 75.6, 286, 314; D28/61; 206/740, 743, 558, 564, 1.8; 211/11, 39, 128.1

[56] References Cited

U.S. PATENT DOCUMENTS

| | | | |
|---|---|---|---|
| D. 83,409 | 2/1931 | Manfredi | D28/61 |
| D. 158,223 | 4/1950 | Schubert et al. | 132/73 |
| D. 170,669 | 10/1953 | Wagner | D28/61 |
| D. 208,376 | 8/1967 | Caccia | D28/61 |
| D. 376,671 | 12/1996 | Schonhorn | D28/61 |
| 1,844,698 | 2/1932 | Snyder | 132/73.5 |
| 2,477,921 | 8/1949 | Batton et al. | 132/73 |
| 2,741,048 | 4/1956 | Shelton | 211/39 |
| 2,760,500 | 8/1956 | Johnson, Jr. | 132/73.5 |
| 3,917,106 | 11/1975 | Bargetzi | 211/39 |
| 4,296,766 | 10/1981 | Benis | 132/73.5 |
| 4,901,846 | 2/1990 | Lehman | 206/1.8 |
| 5,139,036 | 8/1992 | Pickard | 132/73.5 |
| 5,782,379 | 7/1998 | Traub et al. | 132/73 |

*Primary Examiner*—Todd E. Manahan
*Attorney, Agent, or Firm*—Jones, Day, Reavis & Pogue

[57] ABSTRACT

A fingernail stamper craft set comprising a base having five regions at five vertical different levels where the top surfaces of each region include one or more recesses. The first region at the lowest level includes recesses for receiving the fingers of a user having the nails to be decorated. The second region includes recesses for receiving nail enhancement accessories such as nail polish, cotton balls, emery boards and ink pads. The third and fourth regions include recesses for receiving stampers including stampers bearing letters of the alphabet and stampers bearing designs. The fifth or top region includes a recess for storing nail stickers. The nail stamper base may be engageable by another base from a nail enhancement set where the second base also has a number of recesses for accessories.

8 Claims, 6 Drawing Sheets

FINGERNAIL STAMPER CRAFT SET

BACKGROUND OF THE INVENTION

1. Field of the Invention

The present invention relates to a craft set and more particularly to a craft set to facilitate the decorating of an individual's fingernails.

2. Description of the Related Art

There have been numerous craft and/or toy sets in the marketplace, especially craft sets for children. Included are sets which allow children to mimic adult activity or to enhance creativity in the form of art projects.

There is a continuing need in the marketplace for new and creative products for entertainment purposes, play value and to enhance creative and artistic skills.

BRIEF SUMMARY OF THE INVENTION

What is offered here is a new and exciting craft set primarily for children with enhanced play and entertainment value and for encouraging artistic and other creative talents. What is described is a craft set comprising a base divided into a plurality of regions, each having a top surface at different vertical levels and wherein at least most of the top surfaces include recesses. The regions are spaced to have a generally progressive increase in vertical levels and the recesses hold such items as nail polish containers, stampers, ink pads, cotton balls and emery boards. The stampers may include the letters of the alphabet as well as different designs such as stars, hearts and the like.

An object of the present invention is to provide a craft set to facilitate the decoration of fingernails, especially the nails of children. Another aspect of the present invention is to provide a craft set that allows the user to stamps letters and/or designs on his/her fingernails. A further aim of the present invention is to provide a craft set which is relatively inexpensive and simple to use. Yet another advantage of the present invention is to provide a craft set which is esthetically pleasing, fun to use and which enhances a child's creativity and artistic abilities. Still another advantage of the present invention is to provide a nail decorating craft set having a base for the storage of nail polish, nail stampers, ink pads, nail decorating items, cotton balls and emery pads. Yet another aspect of the present invention is to provide a nail enhancing set including a base with a work region and several different storage regions disposed at different vertical heights.

A more complete understanding of the present invention and other objects, aspects, aims and advantages thereof, will be gained from a consideration of the following description of the preferred embodiment read in conjunction with the accompanying drawings provided herein.

DESCRIPTION OF THE PREFERRED EMBODIMENT

Figure 1:
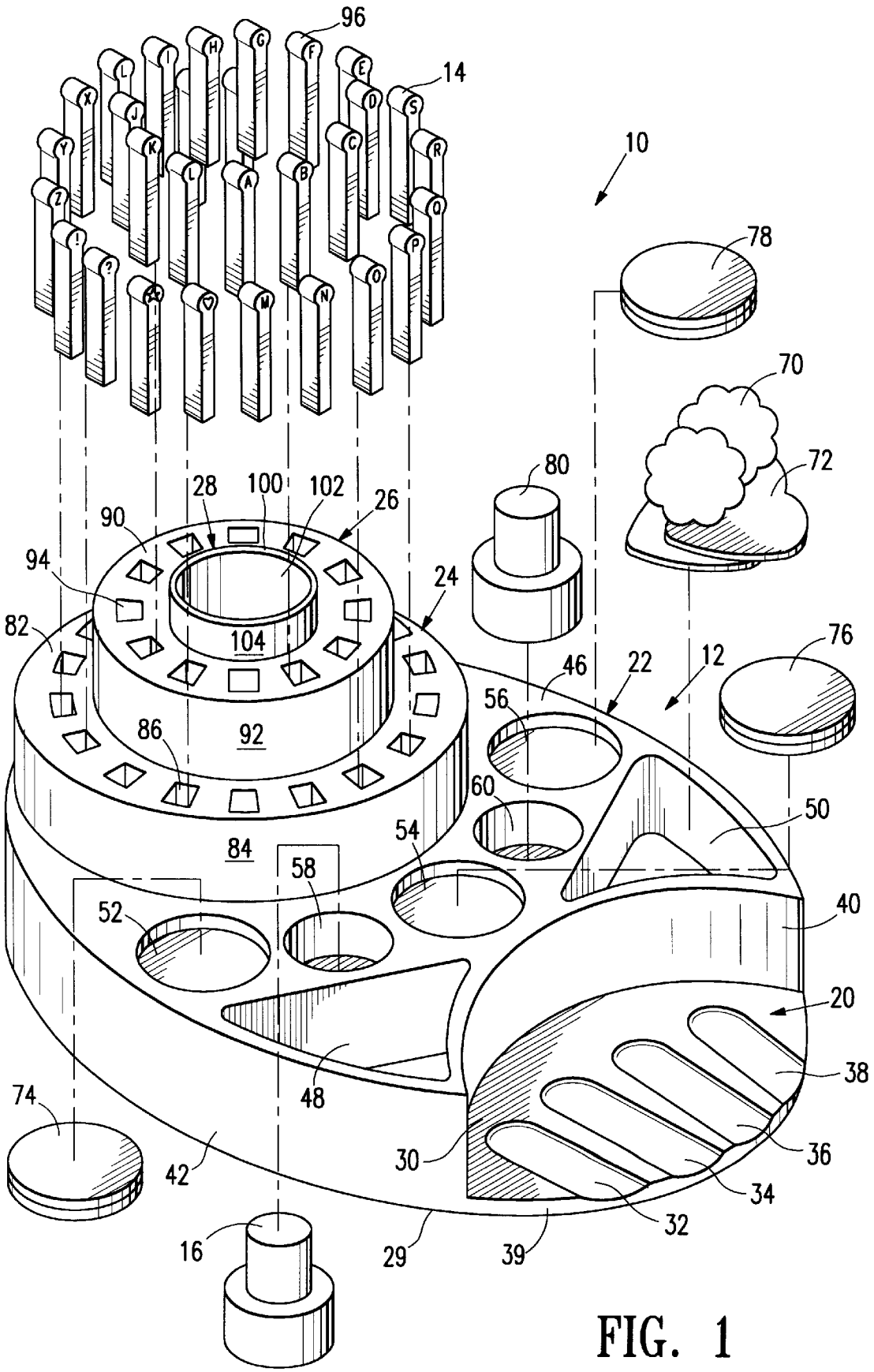
FIG. 1 is an exploded perspective view of a fingernail stamper craft set of the present invention.
Figure 2:
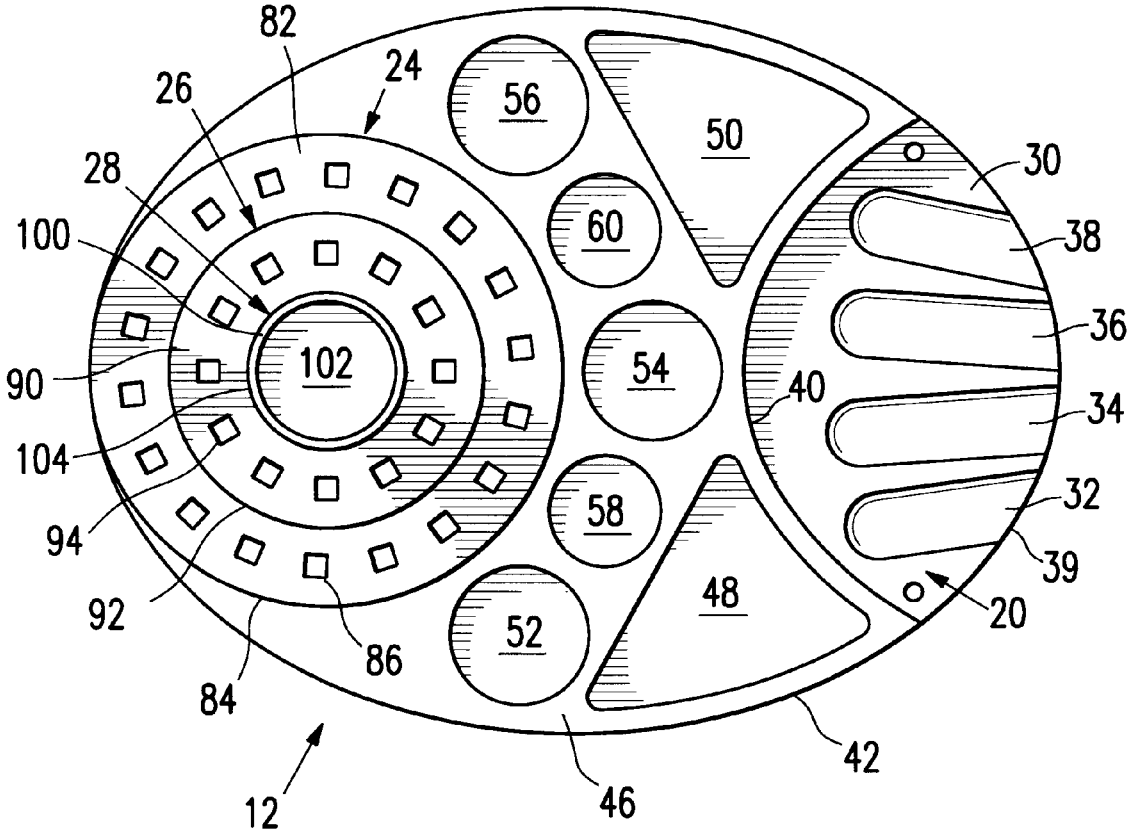
FIG. 2 is a top plan view of the base for the craft set shown in FIG. 1.
Figure 3:
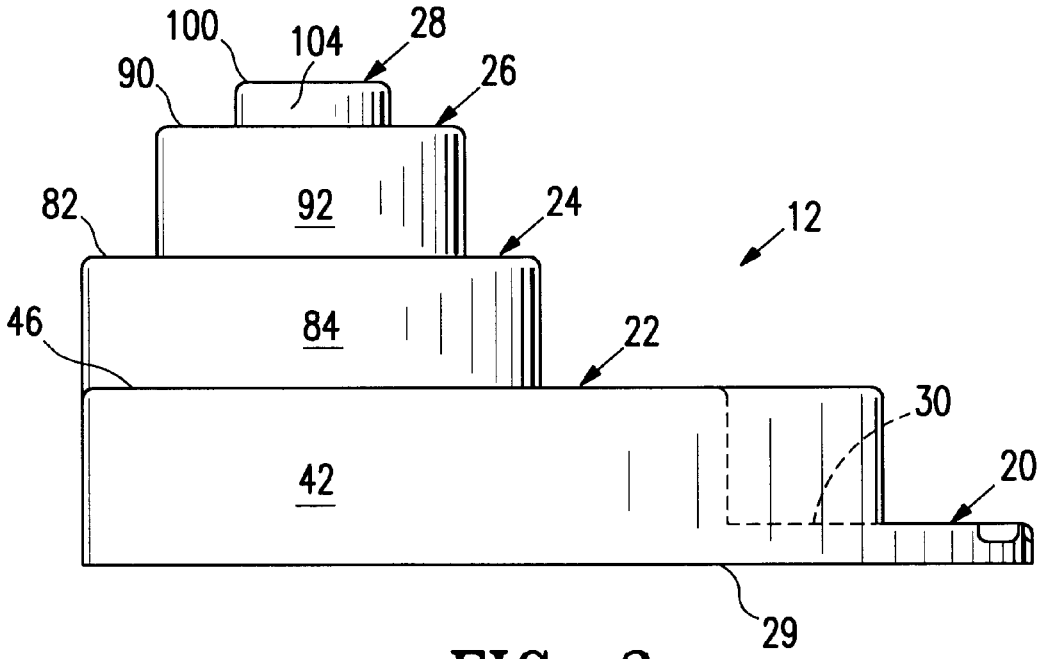
FIG. 3 is a side elevation view of the base shown in FIG. 2.
Figure 4:
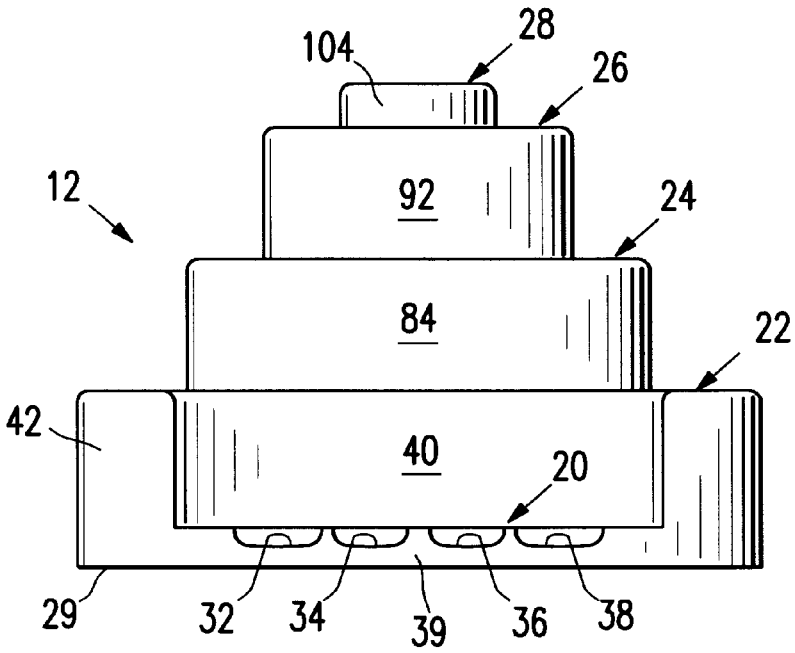
FIG. 4 is a front elevation view of the base shown in FIGS. 2 and 3.

While the present invention is open to various modifications and alternative constructions, the preferred embodiment shown in the drawings will be described herein in detail. It is understood, however, that there is no intention to limit the invention to the particular form disclosed. On the contrary, the intention is to cover all modifications, equivalent structures and methods, and alternative constructions falling within the spirit and scope of the invention as expressed in the appended claims.

Illustrating the simplicity and relative inexpensiveness of the invention herein, reference is made to FIGS. 1–4. There is illustrated a fingernail stamper craft set 10 comprising a base 12, a series of stampers, such as the stamper 14 and several nail enhancement accessories, such as a nail polish bottle 16.

The base 12 is divided into five regions: a first region 20, a second region 22, a third region 24, a fourth region 26 and a fifth region 28. These regions are at different vertical heights or levels relative to a bottom 29 of the base and are arranged so that the regions get progressively higher starting at the lowest vertical level of the first region 20.

The first region is generally elliptical in plan view and includes a top surface 30, four finger recesses 32, 34, 36 and 38 and a front wall portion 39. It can be appreciated that the fingers from a user's hand may be placed in the four recesses, while the user may use his/her other hand to decorate or enhance the fingernails of the fingers resting in the recesses.

Separating the first region 20 from the second region 22 is a front wall 40. A peripheral wall 42 extends around the second region and forms with the front wall portion 39, the periphery of the base. The second region has a generally flat top surface 46 and several recesses. There are two generally triangular recesses 48, 50; three larger circular but shallow recesses 52, 54, 56; and two smaller circular but deeper recesses 58, 60. The triangular recess 48 may be used for the storage for such items as synthetic nails (not shown), whereas the other triangular recess 50 may be used to store such items as cotton balls 70 and emery boards 72. The three shallow recesses 52, 54 and 56 may be used to receive and locate stamper ink pads 74, 76 and 78. The two deeper recesses 58 and 60 may be used to receive nail polish containers, such as the nail polish bottles 16 and 80. The top surface 46 is at an elevation vertically above the level of the top surface 30.

The third region 24 includes a generally flat top surface 82 which is at an elevation level higher than the top surface 46 of the second region 22 and is separated from the second region by a vertical outer wall 84 which is generally cylindrical in shape. There are eighteen recesses, such as the recess 86, spaced evenly about the third region top surface 82. Each of the recesses has a generally rectangular cross-section for receiving and locating a stamper.

The fourth region 26 includes a generally flat top surface 90 which is separated from the top surface 82 of the third region by a vertical outer wall 92, also having a generally cylindrical shape. As with the recesses in the top wall of the third region, there are twelve recesses, such as the recess 94, in the top surface 90 of the fourth region 26. These twelve recesses are spaced about the top surface generally evenly and each has a generally rectangular cross-section. The recesses in the top surface 90 also store and locate stampers, such as the stamper 96.

The fifth region 28 has a narrow ring-like top surface 100 with a large cylindrical recess 102. The top surface 100 of the fifth region is at a vertical height greater than the height of the top surface 90 of the fourth region and is separated from the fourth region by a vertical wall 104 which also has a cylindrical shape. The recess 102 may be used for locating and storing adhesive nail stickers (not shown).

The base may be made from any suitable synthetic resin and may be molded as one piece. One such suitable plastic is ABS.

Figure 5:
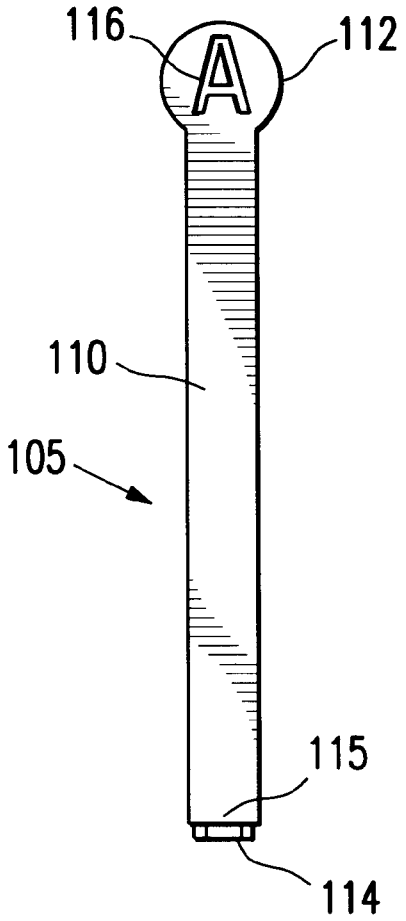
FIG. 5 is a front elevation view of a nail stamper.
Figure 6:
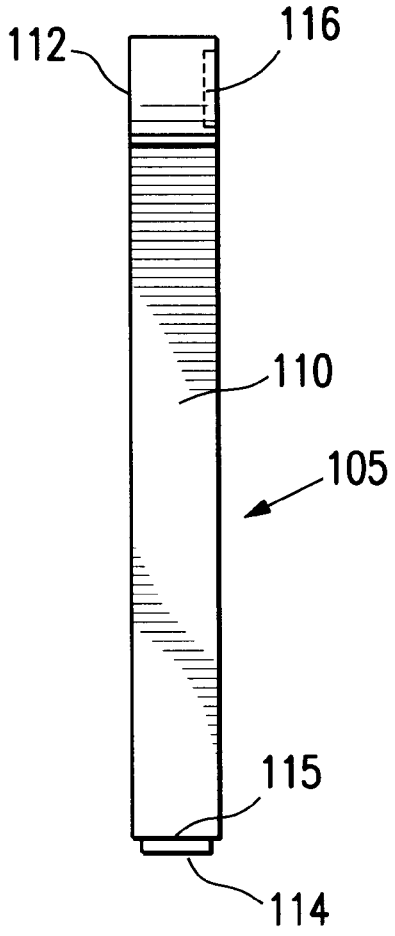
FIG. 6 is a side elevation view of the nail stamper shown in FIG. 5.
Figure 7:
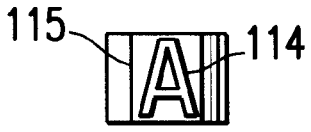
FIG. 7 is a bottom view of the nail stamper shown in FIGS. 5 and 6.

Referring now to FIGS. 5, 6 and 7, there is illustrated the configuration of a stamper 105. Each stamper is essentially identical, except of course, for the design or symbol it carries. Each stamper has a generally elongated body 110, a generally cylindrical head 112 and a raised stamp symbol 114 in the foot 115. As best seen in FIG. 7, the stamp symbol 114 has the shape of a letter of the alphabet, in this case the letter "A", which will always appear backwards in order to properly reproduce when applied to a nail. An identical symbol 116 for reference purposes is shown in the head 112 and is formed by being recessed. The recessed symbol in the head will, of course, match the stamp symbol in the foot. As can be seen by referring back to FIG. 1, there are twenty six stampers each bearing a letter of the alphabet and four stampers having different designs such as a heart, a star, a question mark and an exclamation mark. The dimensions of each stamper may be approximately 1.57 inches in height, 0.142 inches in width and 0.17 inches in depth. The stamp symbol 114 may be raised approximately 0.3 inches whereas the recessed symbol 116 in the head may be recessed 0.3 inches.

The overall size of the base, which is oval in shape, includes a long dimension of about 7.7 inches and a short dimension of about 5.55 inches. The first region which is somewhat shaped like the profile of a football may have a long dimension of about 4.03 inches and a short dimension of about 1.21 inches. The finger recesses 32, 34, 36 and 38 may be approximately 0.125 inches in depth and roughly 2 inches in length. In the second region 22, the triangular recesses may have a depth of about 1 inch whereas the shallow recesses 52, 54 and 56 may each have a depth of about 0.375 inches. The deeper recesses 58 and 60 may each have a depth of about 0.625 inches. The diameters of the second region recesses may be sized to match the containers they receive. The top surface of the second region may be 1.125 inches above the top surface of the first region.

The diameter of the third region may be about 3.75 inches, and the top surface 82 may be at an elevated distance of about 1 inch from the top surface 46 of the second region. Each of the stamper receiving recesses may be 0.75 inches in depth and slightly larger than the dimensions of the stampers (0.17×0.142 inches).

The diameter of the fourth region may be 2.5 inches and the top surface 90 may be about 1 inch above the top surface 82 of the third region. The depths of the stamper receiving recesses in the fourth region are also about 0.75 inches.

The fifth region 28 may have an outer diameter of about 1.25 inches, an inner diameter of about 1.125 inches and a recess depth of about 1.5 inches. The height of the top surface 100 above that of the top surface 90 may be about 0.375 inches.

Figure 8:
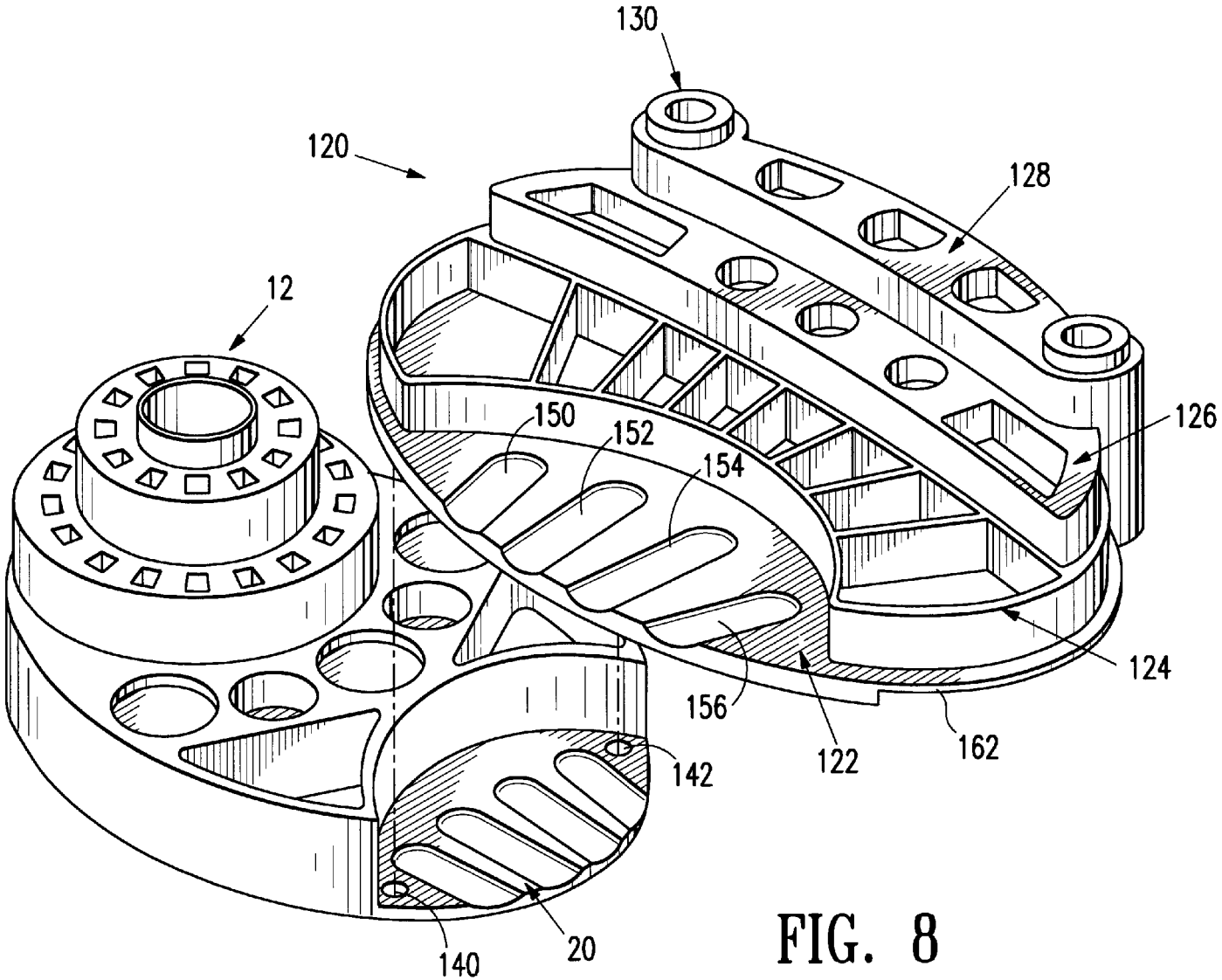
FIG. 8 is a perspective view of the base shown in FIGS. 1–4 and a perspective view of a base from a fingernail enhancement craft set, the bases being shown in a disengaged position.
Figure 10:
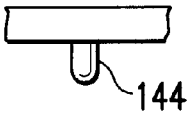
FIG. 10 is a partial elevation view of a peg of the enhancement craft set base.
Figure 9:
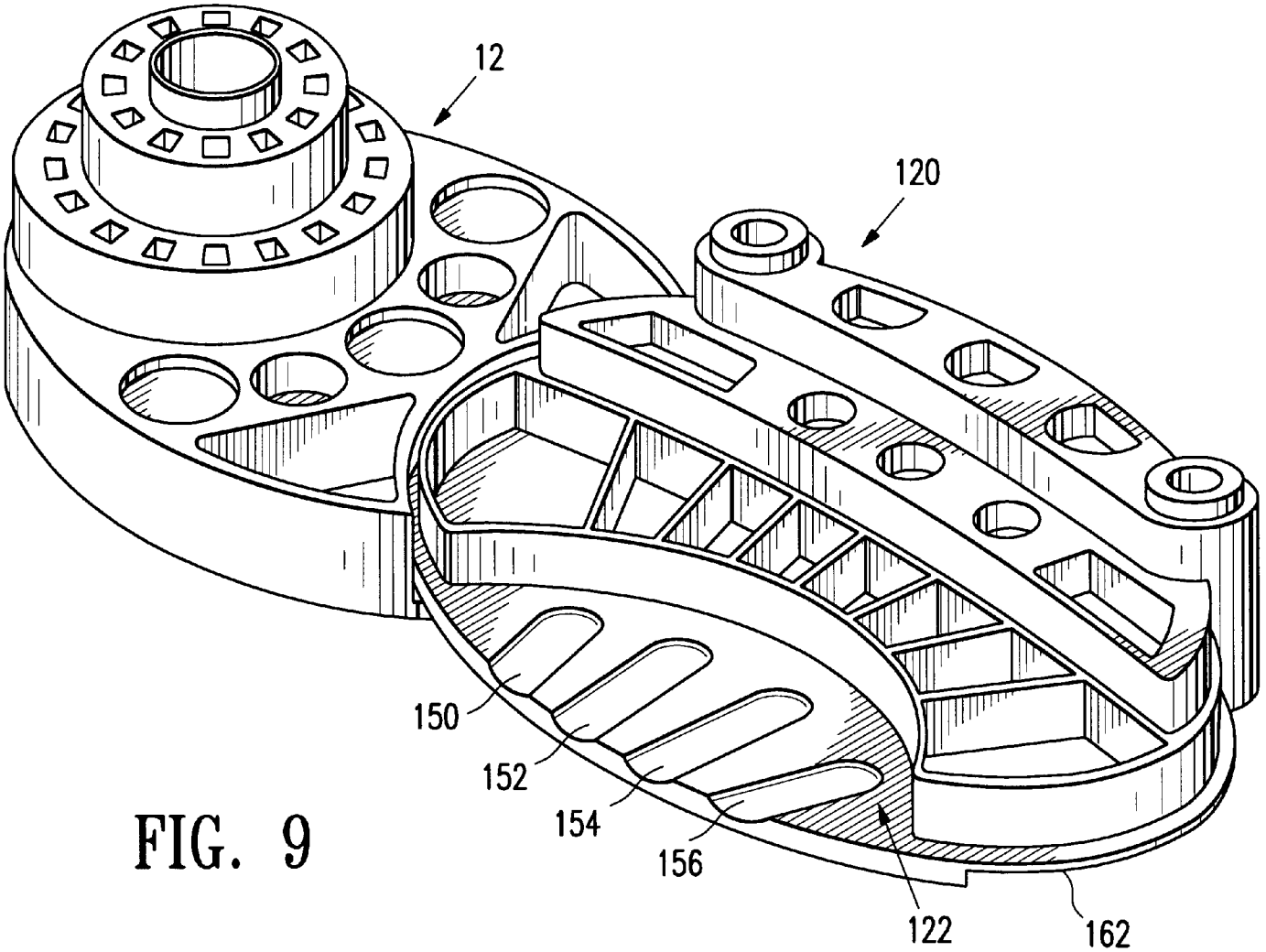
FIG. 9 is a perspective view of the two bases shown in FIG. 8, the bases being shown in an engaged position.

Reference is now made to FIGS. 8 and 9 which show the base 12 of the fingernail stamper craft set in a relationship with a base 120 of a nail enhancing craft set, which base is described in detail in co-pending application, Ser. No. 09/244,244, filed Feb. 3, 1999. As can be seen, the enhancing craft base also has five regions 122, 124, 126, 128 and 130 at different vertical heights. Each of these regions includes a top surface and each of the regions includes multiple recesses in the top surfaces to be used for storing nail enhancing accessories. As already explained above and in the co-pending application, which is incorporated herein by reference, the bases may each be used separately as part of an independent craft set. However, as shown in FIGS. 8 and 9, the bases may also be used together. To achieve an engagement, the stamper craft base 12 has two openings 140, 142 in the first region 20 for receiving two corresponding pegs molded with the bottom of the enhancing craft base 120. An example of one of the pegs is shown in FIG. 10 and is identified by the numeral 144. When the two bases are brought together with the pegs being received by the openings 140, 142, the first region of the stamper craft base 12 will be covered by the enhancement craft base 120. When this occurs, the user may place his/her fingers on indentations 150, 152, 154 and 156 formed in the first region 122 of the enhancement craft base. The enhancement craft base may have cutouts, such as the cutout 162, on each end to allow a relatively flush fit between the two bases and closely aligned the bottom surfaces of the bases so as to achieve stability of the bases when in use.

In operation, a user places his/her fingers of one hand on the four recesses 32, 34, 36, 38 thereby making the first region a work surface. With the other hand (or with the help of another person), the fingernails of the hand may be cleaned and trimmed by using the cotton pads and the emery boards. Thereafter, nail polish, glitter, stickers and/or stamped letters and/or designs may be applied at the desire of the user. If the bases of both the fingernail stamper craft set and the fingernail enhancement craft set are used together, additional accessories may be used as well as tools. For example, such tools as a magnifying glass and a fan may be attached to the base of the enhancement craft set.

The specification describes in detail an embodiment of the present invention. Other modifications and variations will under the doctrine of equivalents come within the scope of the appended claims. For example, having different shaped recesses, or recesses with different dimensions, or having different sized or shaped bases and stampers are all considered to be equivalent structures. Still other alternatives will also be equivalent as will many new technologies and materials. There is no desire or intention here to limit in any way the application of the doctrine of equivalents.

We claim:

1. A craft set for enhancing fingernails of a user, said set comprising:

an integral base having a generally elliptical plan view with a periphery symmetrical about a long axis of said base;

said base having a plurality of vertically displaced levels with each level having a region of recesses or openings;

at least one region having a plurality of openings formed to receive a plurality of stampers;

a plurality of stampers, each of said stampers being shaped to be received by one of said openings, and each of said stampers including a design for leaving a mark on a fingernail; and an ink pad shaped to be received by a recess in said base.

2. An apparatus as claimed in claim 1 including:

a first region located at the lowest vertical level and having finger accommodating recesses;

a second region located at the next lowest level and having a plurality of bins;

a third region located at a vertical level higher than said second region and having a plurality of openings;

a fourth region located at a vertical level higher than said third region and having a plurality of openings; and a fifth region located at a vertical level higher than said fourth region and having an opening.

3. An apparatus as claimed in claim 2 including:

fingernail accessory items including, cotton, emery boards, nail polish and nails being located on said base.

4. An apparatus as claimed in claim 2 wherein:

said first region includes two spaced apart openings.

5. An apparatus as claimed in claim 1 wherein:

said plurality of stampers include as designs the letters of the alphabet.

6. An apparatus as claimed in claim 1 including:

a curved vertical wall disposed between said first and said second regions for defining with said elliptical plan view the shape of said first region.

7. A craft set for enhancing fingernails of a user, said set comprising:

a first base having a generally elliptical plan view with a periphery symmetrical about a long axis of said base;

a second base having a generally elliptical plan view with a periphery symmetrical about a short axis of said base;

each base having a plurality of vertically displaced levels with at least some levels having a region of recesses or openings;

said first base having an end portion including a first region at the lowest vertical level having means for engaging said second base; and said second base having a cutout to received said end portion of said first base and means for engaging said first base whereby said second base engages said first base and partially overlaps said first base.

8. An apparatus as claimed in claim 7 wherein:

said means for engaging said second base are a plurality of openings; and said means for engaging said first base are a plurality of pegs whereby said bases engage one another by having the plurality of pegs of said second base received by the plurality of openings in said first base.

* * * * *